US008016517B1

(12) United States Patent
Pardue

(10) Patent No.: US 8,016,517 B1
(45) Date of Patent: Sep. 13, 2011

(54) ERGONOMIC CONCRETE SCREED HANDLES

(76) Inventor: Darren Scott Pardue, Ada, OK (US)

( * ) Notice: Subject to any disclaimer, the term of this patent is extended or adjusted under 35 U.S.C. 154(b) by 15 days.

(21) Appl. No.: 12/800,758

(22) Filed: May 22, 2010

(51) Int. Cl.
*E01C 19/22* (2006.01)
*B25G 1/10* (2006.01)
*A46B 5/02* (2006.01)
*B05C 17/10* (2006.01)

(52) U.S. Cl. ..... 404/118; 16/430; 15/143.1; 15/235.4

(58) Field of Classification Search ..... 404/112, 404/97, 118; 294/25, 26, 57, 58; 16/430, 16/434, 444; 15/143.1, 234.5, 234.8
See application file for complete search history.

(56) References Cited

U.S. PATENT DOCUMENTS

| | | | | | |
|---|---|---|---|---|---|
| 2,606,050 | A | * | 8/1952 | Morris et al. | 403/328 |
| 2,710,571 | A | * | 6/1955 | Pfister | 172/378 |
| 2,897,735 | A | | 8/1959 | Alessio | |
| 3,574,380 | A | * | 4/1971 | Tague | 294/16 |
| 4,449,845 | A | | 5/1984 | Carrillo | |
| 4,828,427 | A | | 5/1989 | Nisenbaum | |
| 4,962,561 | A | * | 10/1990 | Hamilton | 15/111 |
| 5,060,343 | A | * | 10/1991 | Nisenbaum | 16/421 |
| 5,156,429 | A | * | 10/1992 | Adams | 294/25 |
| 5,771,535 | A | | 6/1998 | Blessing | |
| 5,980,154 | A | | 11/1999 | Record | |
| 6,082,795 | A | * | 7/2000 | Fornelli | 294/58 |
| 7,131,255 | B1 | * | 11/2006 | Caneba | 56/400.19 |
| 7,491,013 | B2 | | 2/2009 | Bohse | |
| 7,637,882 | B2 | * | 12/2009 | Carman et al. | 602/21 |
| 2004/0055099 | A1 | * | 3/2004 | Greenberg | 15/143.1 |
| 2006/0179592 | A1 | * | 8/2006 | Landers | 15/143.1 |
| 2006/0291958 | A1 | * | 12/2006 | Argento et al. | 404/118 |

* cited by examiner

*Primary Examiner* — Thomas Will
*Assistant Examiner* — Abigail A Risic
(74) *Attorney, Agent, or Firm* — Randal D. Homburg

(57) ABSTRACT

A paired set of handles attaching to a board forming a concrete screed to minimize the strain on a person performing concrete finishing work allows for an ergonomic application of downward force applied to the lower end of the handles and application of an upward lifting force by the shape of the grip portion at the upper end of the handles, with the shape and contour of the handles requiring less strain and strength than current screed handles.

5 Claims, 4 Drawing Sheets

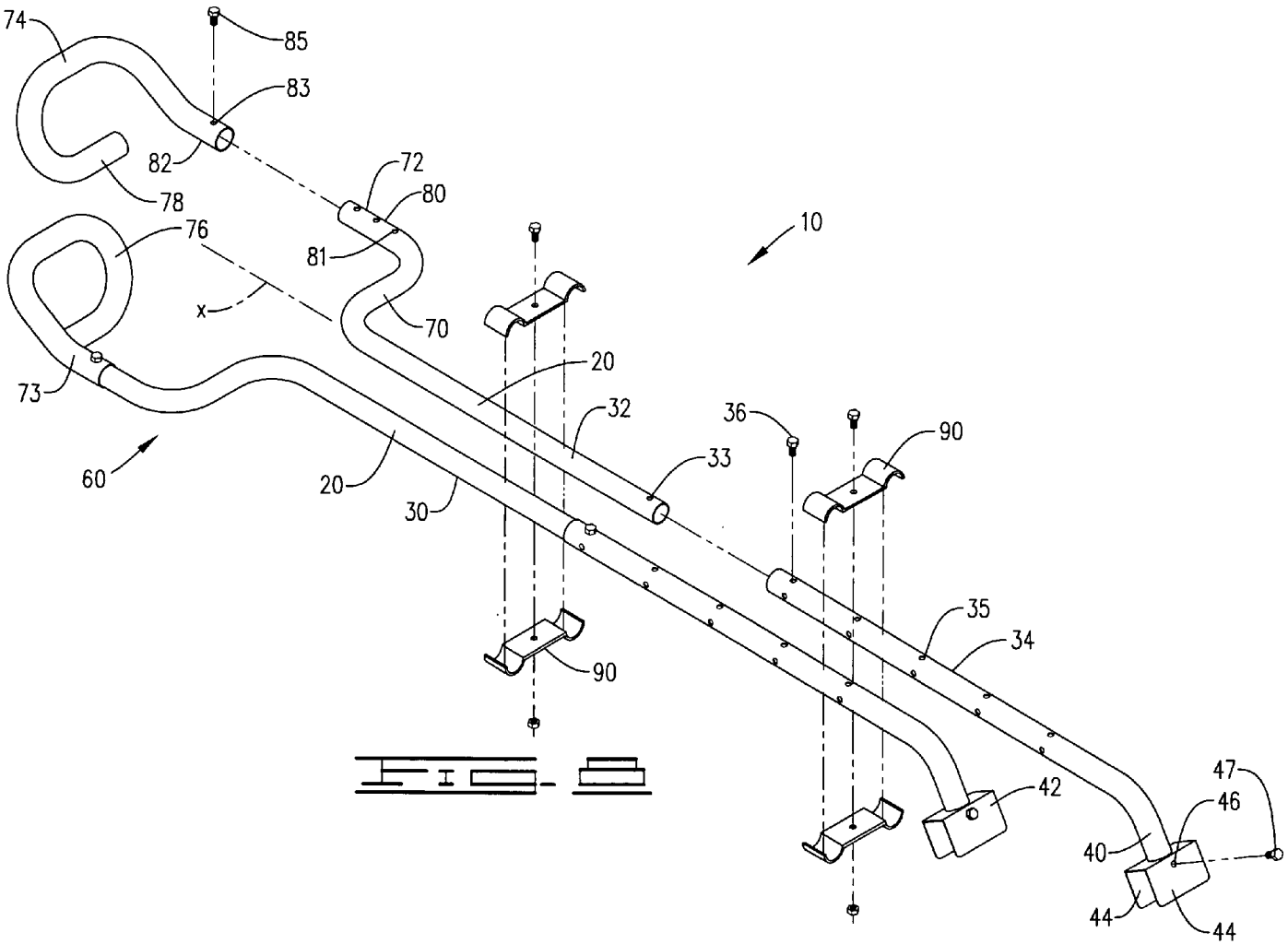
10
20
30
32
33
34
35
36
40
42
44
44
46
47
60
70
72
73
74
76
78
80
81
82
83
85
90
90
x

ERGONOMIC CONCRETE SCREED HANDLES

CROSS REFERENCE TO RELATED APPLICATIONS

None.

BACKGROUND OF INVENTION

1. Field of the Invention

A paired set of handles attaching to a board forming a concrete screed to minimize the strain on a person performing concrete finishing work allows for an ergonomic application of downward force applied to the lower end of the handles and application of an upward lifting force by the shape of the grip portion at the upper end of the handles, with the shape and contour of the handles requiring less strain and strength than current screed handles.

2. Description of Prior Art

A preliminary review of prior art patents was conducted by the applicant which reveal prior art patents in a similar field or having similar use. However, the prior art inventions do not disclose the same or similar elements as the present pair of screed handles, nor do they present the material components in a manner contemplated or anticipated in the prior art.

In U.S. Pat. No. 7,491,013 to Bohse, a handle attachment is indicated which provides alternate grip sites on an otherwise simple elongated handle. U.S. Pat. No. 5,980,154 to Record show a pair of screed handles connected together with intermediary grip handles and upper cuff handles steadied against the forearms of the user while surfacing concrete to provide a more stable screed apparatus.

A multiple contoured handle apparatus to be applied to conventional tools is indicated in U.S. Pat. No. 5,771,535 to Blessing, with FIG. 15 showing a handle bent along a three dimensional axis, but not in the same manner or serving the same ergonomic function as the present paired screed handles. A pivotal axis handle is demonstrated in U.S. Pat. No. 4,828,427 to Nisenbaum. Two different adjustable screed frame members are indicated in U.S. Pat. Nos. 4,449,845 to Carrillo and 2,897,735 to Alessio, both of them having a belt to anchor the device to the operator while the screed is being used.

SUMMARY OF THE INVENTION

A concrete screed device has been used in the concrete finishing process most likely since the advent of concrete itself. The least sophisticated of these screed is a simple flat board which is drawn on the surface of the concrete to provide the concrete with a smooth and level surface. Over time, most likely due to wear and tear on the backs of the people performing the concrete finishing being bent over while using a simple flat board, these board started to have handles or extensions attached to the boards to allow the operator to stand in an upright position while keeping the board level and consistent over the surface of the concrete. Most of the advances in concrete screed have been directed towards stabilization of the screed while somewhat providing less stress on the operator.

The present concrete screed handles are provided in pairs, each directed to opposing arms of the operator, while formed in a mirror image of one another. Each handle has two ends, a lower end attached to the screed board, and an upper end forming a multiple bent handle which is different than any related prior art device. The upper end configuration provides each handle to incur a downward force when the hand is forces downward using the leverage against the forearm, and an upward force distributed along the hand and lower forearm near the wrist to lift the screed, providing the operator with more finesse and control over the screed during the finishing process with a reduced amount of stress to the operators back and legs and without having to alter the operator's grip in the concrete finishing process.

DESCRIPTION OF THE DRAWINGS

The following drawings are informal drawings submitted with this provisional patent application.

FIG. 8 is an exploded view of the component parts of the ergonomic concrete screed handles.

DESCRIPTION OF THE PREFERRED EMBODIMENT

Figure 1:
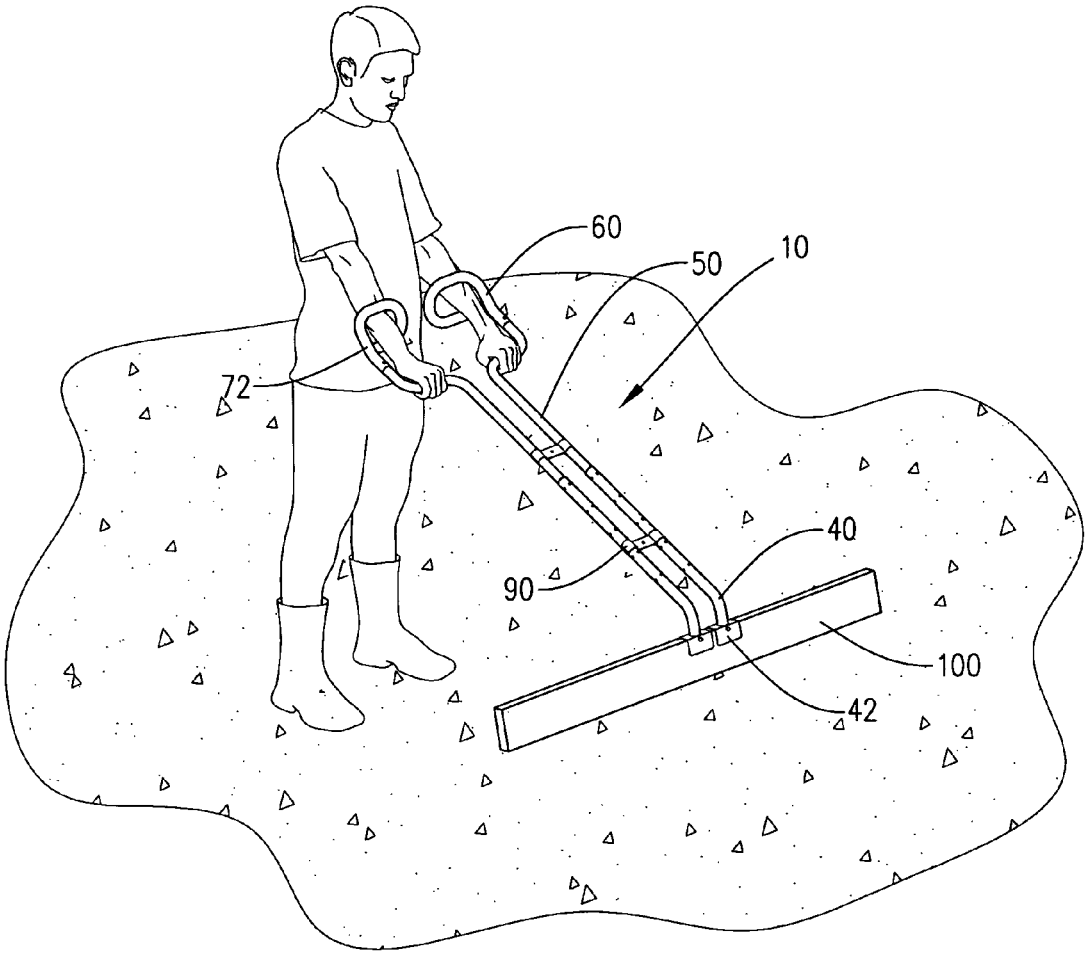
FIG. 1 is a view of the ergonomic concrete screed handles and operator during the concrete finishing process.
Figure 2:
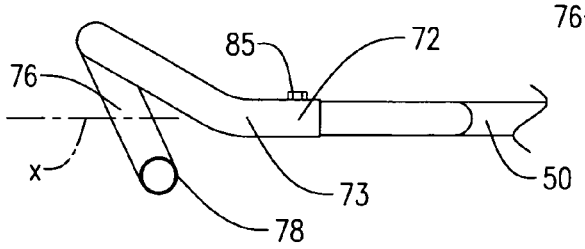
FIG. 2 is a side view of the upper end of one handle portion.

A modified handle assembly 10 utilized with a concrete screed board 100, provides a pair of separate screed handles 20, as indicated in FIGS. 1-8, each screed handle 20 applied to a separate arm of the operator and formed in a mirror image of one another for the purpose of use to smooth the surface of wet concrete. Each modified handle 20 provides a shaft 30 having a lower end 40 attached to a common screed board 100 by a board attaching means 42, FIG. 8, and an upper end 50, FIGS. 3-4 and 6-7, forming a multiple bend leveraged grip portion 60. An optional handle connecting means 90, FIGS. 1, 5 and 8, may be attached between each handle shaft 30, if desired, but it is not required for use.

The upper end 50 provides each grip portion 60 to generate a downward rotational force when the user's hands are forces downward with leverage against the lower forearm near the wrist, and an upward rotational force with the gripped hand being elevated against the lower forearm away from the wrist to lift the screed. The multiple bend leveraged grip portion 60 provides the operator with more finesse and control over the screed board during the concrete finishing process with a reduced amount of stress to the operators arms, hands, shoulders, back and legs and without having to alter the operator's hand grip upon the handles.

The grip portion 60, FIGS. 2-3 and 6-7, is formed in a three dimensional axis to supply a first section 70 perpendicular to a linear axis X defined by the shaft 30 of each handle 20. A second section 72 extends perpendicularly from the first section 70 away from the shaft 30 and with an upward transitional bend 73 rising above the linear axis X of the shaft 30. A third section 74 extends perpendicular to the linear axis X of the shaft 30, parallel to the first section 70. A fourth curved section 76 extends downward and back towards the first section 70, and terminates below the linear axis X, transitioning into a fifth section 78 extending back towards the second section 72. The first, third and fifth sections 70, 74, 78 are parallel to one another, FIGS. 3 and 7, with the second section 72 parallel to the linear axis X of the shaft 30 when observed from the side, FIGS. 3 and 6. It is also observed from FIGS. 3 and 6, that the fifth section 78 is below the linear axis X, the third section 74 is above the linear axis X and the first section 70 is along the linear axis X, thus providing the first section 70 for a user's hand to grasp, the third section 74 positioned against the user's upper forearm and the fifth section 78 located below the forearm near the user's wrist, FIGS. 6 and 7.

Figure 5:
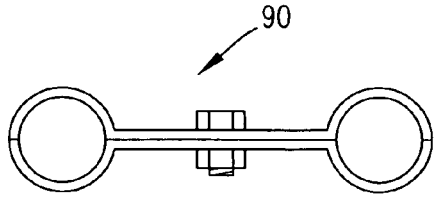
FIG. 5 is a top view of an embodiment of a handle connecting means.

One or more of the optional handle connecting means 90 provide for a fixed width between the shafts 30 of the two handles 20, attached to the shaft 30 between the upper and lower ends 40, 50 of the handles 20, and may be slidably connected to each handle 20 anywhere along the shaft 30, FIGS. 1 and 8. The connecting means 90 provides the handles 20 to be spaced apart for the comfort of the user to position the hands and arms of the user at a preferred shoulder's width, FIG. 1. One embodiment of the handle connecting means 90 is indicated in FIG. 5 of the drawings, although there may be several different embodiments of the handle connecting means employed to secure the two shafts together at one or more different widths.

Figure 4:
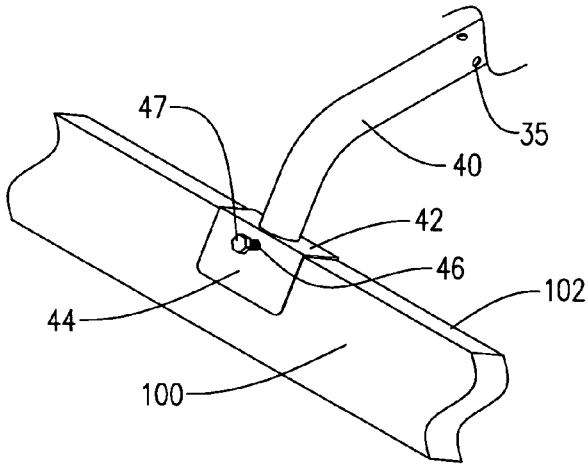
FIG. 4 is an upper perspective view of the lower end with the board attaching means attached to a screed board.

The lower end 40 of each handle is spread apart at a selected width appropriate to the user's comfort, with each lower end 40 connected to a flat and sturdy screed board 100 by the board attaching means 42, FIGS. 1, 4, and 8. The handle connecting means 90, if used, would be positioned and secured to the shafts 30 of the handles 20 at a coordinated width of the connected board attaching means 42. The respective first sections 70 should be directed away from each other when used, FIGS. 1 and 8, with each second section 72 located on the outside of each of the user's arms, again preferably at a comfortable distance approximately equal to the shoulders' width, FIG. 1. FIGS. 4 and 8 indicate one embodiment of the board attaching means 42, which is provided as a pair of spaced extensions 44 having two or more transverse bores 46 through each spaced extension 44 with a screw, nut and bolt, or a locking pin inserted through each aligned transverse bores and either into or through the screed board 100 along an upper margin 102. As indicated by example in FIG. 8, set screws 47 traveling through threaded transverse bores 46 are shown to secure the attaching means 42 to the upper margin 102 of the screed board 100.

Figure 6:
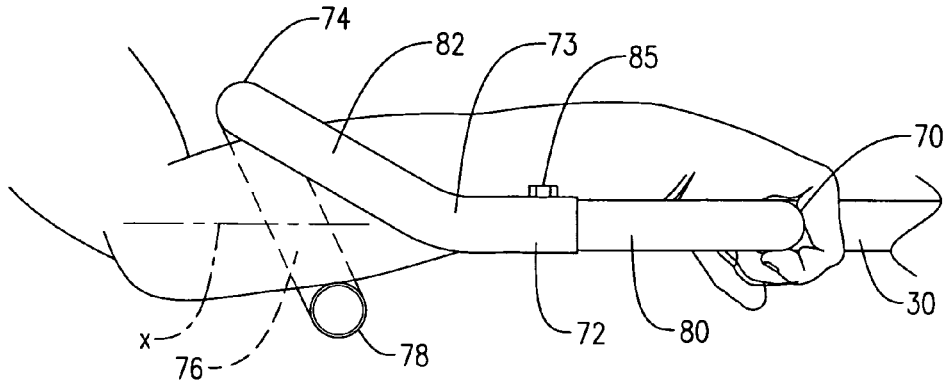
FIG. 6 is a side view of an upper end of a handle with a user's arm in position for use.

The user grasps the first section 70 of each handle 20 with their hands, with the fifth section 78 positioned below the lower forearm near wrist and the third section 74 resting atop the forearm, FIGS. 6-7. With an extension of the forearms and hands downward, the user applied a leveraged downward rotational force to the lower end 40 where a controlled amount of pressure is desired on the screed board 100 during the concrete finishing process, with the third section 74 forced against the upper forearm. Lifting the grasped hand and the first section 70 with an upper force applied to the lower forearm near the wrist by the fifth section 78 will lift the lower ends 40 of the handles 20 and attached screed board 100 from the concrete surface during the concrete finishing process when necessary. The grip upon the first section 70 should remain constant during the finishing process.

The shafts 30 of each of the handles 20 should also be provided with a telescopic extension means to allow the handles to be extended or retracted to length to allow users of varying height to position the screed board in an ergonomically correct position in accordance with the shoulder's width, height and arm length of the individual user, as indicated in FIGS. 1 and 8. An embodiment of one telescopic means is indicated in FIG. 8, although other embodiments of a telescopic extension means may be employed, the telescopic shaft defining an upper shaft section 32 having a single alignment hole 33 and a lower shaft section 34 having a plurality of adjustment holes 35 slidably engaged within the upper shaft section with a shaft locking means 36 to secure a selected lower shaft section adjustment hole 35 with the single alignment hole 33 of the upper shaft section 32, FIG. 8.

Figure 3:
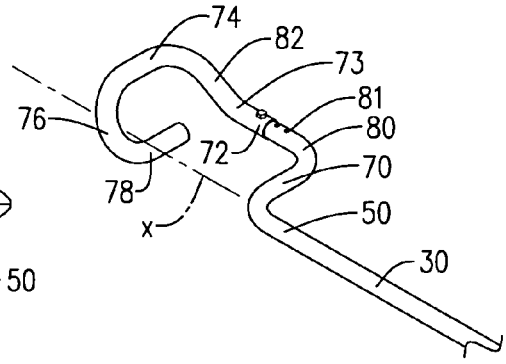
FIG. 3 is a top perspective view of the upper end of one handle portion.
Figure 7:
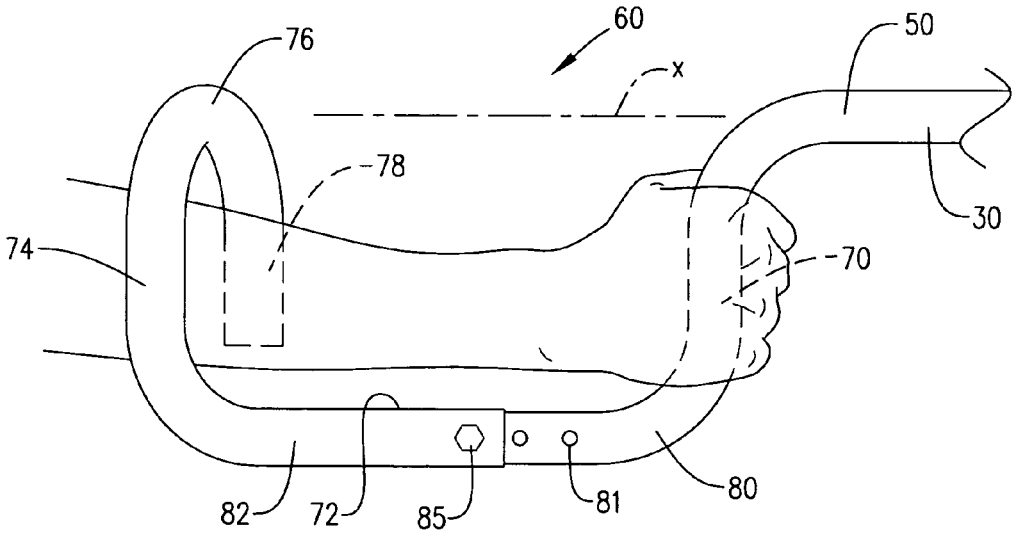
FIG. 7 is a top view of the upper end and the user's arm as shown in FIG. 6.

There may also be some means of expansion located on the second section 72, FIGS. 3, 7 and 8, to properly adjust and locate the third and fifth sections 74, 78 at appropriate points along the forearms of the user, providing the device for use by a variety of different size and shaped users having different height, arm lengths, shoulder widths and differing levels of upper body strengths. In this embodiment, the second section is provided with a straight lower second section portion 80 having a plurality of adjustment holes 81 and an upper second section portion 82 having a single alignment hole 83 and including the upward transitional bend 73, along with the third section 74, fourth curved section 76 and fifth sections 78, with the single alignment hole 83 of the upper second section portion 82 and a selected adjustment hole 81 of the lower second section portion 80 attached by a second section attaching means 85, seen in FIGS. 2-3, and 6-8 as a bolt.

While the improvement is directed to screed handles, it should be recognized that the upper end and grip portion may be incorporated into any device that could use paired handles or even a single handle for an operation either occurring above or below the waist of a user. Although the embodiments of the improved screed handles have been described and shown above, it will be appreciated by those skilled in the art that numerous modifications may be made therein without departing from the scope of the improved handles or the intended and disclosed nature and purpose of the improved handles as herein described.

I claim:

1. A handle assembly utilized with a concrete screed board to smooth a surface of wet concrete, providing a pair of separate screed handles, each screed handle for engagement with a separate arm of an operator and formed in a mirror image of one another, each said screed handle comprising:

a shaft defining a linear axis and having a lower end defining a board attaching means attached to the common screed board, and an upper end forming a multiple bend leveraged grip portion, said grip portion further defining a first section bending perpendicular to said linear axis, a second section extending perpendicularly from said first section away from said shaft and having an upward transitional bend placed above said linear axis, a third section extending perpendicular to said linear axis and parallel to said first section, a fourth curved section extending downward and back towards said first section, and terminating below said linear axis and further transitioning into a fifth section extending back towards said second section, said fifth section below said linear axis, said third section above said linear axis and said first section along perpendicular to said linear axis, thus providing said first section for each said operator's respective hand to grasp, said third section for positioning against said operator's respective upper forearm and said fifth section for positioning against said operator's respective lower forearm, wherein said handles are adapted to provide the operator with more control over the screed board during the concrete finishing process.

2. The handle assembly, as disclosed in claim 1, further comprising:

each said screed handle having a telescopic shaft defining an upper shaft section having a single alignment hole and a lower shaft section having a plurality of adjustment holes slidably engaged within the upper shaft section with a shaft locking means to secure a selected lower shaft section adjustment hole with the single alignment hole of the upper shaft section, wherein said telescopic shaft is adapted to be extended or retracted in length to allow operators of varying height to position the screed board in an ergonomically correct position.

3. The handle assembly, as disclosed in claim 1, further comprising:

at least one handle connecting means providing a fixed distance between said shafts between respective upper and lower ends of said shafts.

4. The handle assembly, as disclosed in claim 1, said second section further comprising:

a straight lower second section portion having a plurality of adjustment holes; and an upper second section portion having a single alignment hole and including said upward transitional bend, along with said third, fourth and fifth sections, with said single alignment hole of said upper second section portion and one of said plurality of adjustment holes of said lower second section portion attached by a second section attaching means, wherein said grip portion is adapted for use by a variety of different operators.

5. The handle assembly, as disclosed in claim 1, further comprising:

each said screed handle having a telescopic shaft defining an upper shaft section having a single alignment hole and a lower shaft section having a plurality of adjustment holes slidably engaged within the upper shaft section with a shaft locking means to secure a selected lower shaft section adjustment hole with the single alignment hole of the upper shaft section;

at least one handle connecting means providing a fixed distance between said shafts between respective upper and lower ends of said shafts; and said second section further defining a straight lower second section portion having a plurality of adjustment holes and an upper second section portion having a single alignment hole and including said upward transitional bend, along with said third, fourth and fifth sections, with said single alignment hole of said upper second section portion and one of said plurality of adjustment holes of said lower second section portion attached by a second section attaching means, wherein said telescopic shaft is adapted to allow operators of varying height to position the screed board in an ergonomically correct position and said second section of said grip portion is adapted for use by a variety of different operators.

* * * * *